US006216592B1

(12) United States Patent
Knauer et al.

(10) Patent No.: US 6,216,592 B1
(45) Date of Patent: Apr. 17, 2001

(54) DOUBLE PRINTING UNIT OF A ROTARY PRINTING MACHINE

(75) Inventors: Peter Knauer, Münster/Lech; Josef Singler, Wertingen, both of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/458,629

(22) Filed: Dec. 10, 1999

(30) Foreign Application Priority Data

Dec. 10, 1998 (DE) ..... 198 56 906

(51) Int. Cl.[7] ..... B41F 13/24
(52) U.S. Cl. ..... 101/247; 247/218
(58) Field of Search ..... 101/247, 218, 101/219, 216, 248, 177

(56) References Cited

U.S. PATENT DOCUMENTS

| | | | | |
|---|---|---|---|---|
| 4,072,104 | * | 2/1978 | Schaffer | 101/247 |
| 4,458,590 | | 7/1984 | Egnaczak et al. | 101/247 |
| 4,643,090 | * | 2/1987 | McKrell et al. | 101/218 |
| 4,833,982 | * | 5/1989 | Liebert et al. | 101/477 |
| 5,337,664 | * | 8/1994 | Hannon | 101/218 |
| 5,979,317 | * | 11/1999 | Singler | 101/218 |
| 6,019,039 | * | 2/2000 | Knauer et al. | 101/247 |
| 6,032,579 | * | 3/2000 | Richards | 101/219 |
| 6,085,651 | * | 7/2000 | De France et al. | 101/247 |

FOREIGN PATENT DOCUMENTS

| | | |
|---|---|---|
| 549 471 | 5/1974 | (CH) . |
| 3412812 C1 | 6/1985 | (DE) . |
| 93 11 113 U | 10/1993 | (DE) . |
| 43 37 554 A1 | 6/1994 | (DE) . |
| 296 08 887 U1 | 8/1998 | (DE) . |

* cited by examiner

*Primary Examiner*—Eugene Eickholt
(74) *Attorney, Agent, or Firm*—Cohen, Pontani, Lieberman & Pavane

(57) ABSTRACT

Large throw-off distances of the transfer cylinders in a double printing unit of a rotary printing machine operating on the rubber/rubber principle are achieved by enabling the two transfer cylinders to be set away from each other, and enabling the two form cylinders to be set away from the respective transfer cylinder. The form cylinder and the transfer cylinder of each printing unit have a drive connection via spur gears, the transfer cylinders are not in tooth engagement via their spur gears, and each printing unit has its own electric motor.

10 Claims, 3 Drawing Sheets

DOUBLE PRINTING UNIT OF A ROTARY PRINTING MACHINE

BACKGROUND OF THE INVENTION

1. Field of the Invention

The invention relates printing machines, and more particularly, to a double printing unit of a rotary printing machine which can be switched off for a rapid production change, while the web continues to be led through between the transfer cylinders which have been moved out of contact.

2. Description of the Related Art

DE 93 11 113 U1 shows a double printing unit serving as a single printing unit, in which the form and transfer cylinders are arranged one above another. All four printing-unit cylinders have a drive connection to spur gears located on their journals. The drive is provided by means of a main shaft via a bevel-gear mechanism and an intermediate gear on one of the spur gears of the transfer cylinders. This drive can be disengaged by means of a clutch when the double printing unit is switched off for a plate change needed in the event of a production change. In order to put the drive back into service, the double printing unit is accelerated by means of an auxiliary drive, then coupled to the main shaft and finally printing is thrown on.

In the case of the single printing unit, the transfer cylinders have to be thrown relatively far off in the thrown-off state in order to lead the web which is printed, or is to be printed, by other printing units horizontally through between the transfer cylinders without contact. However, in order to prevent the spur wheels from being disengaged, limits are placed on the extent of the spacing. It is also necessary for there to be sufficient tooth engagement in order to accelerate a double printing unit of this type before printing is switched on in the event of a production change. Guide rolls are therefore provided upstream and downstream of the double printing unit. The guide rolls aid in the leading of the web through and between the transfer cylinders spaced apart from one another. The guide rolls make the double printing unit costly. Furthermore, ink is deposited on them, and, in a reverse action, is smeared on the web again.

According to Swiss Patent 549 471, the transfer cylinders of a double printing unit are each mounted in levers which can be pivoted around the associated form cylinder. The form and transfer cylinders and the transfer cylinders have a mechanical drive connection via spur gears on their journals. For the purpose of throwing off the printing, the levers, together with the transfer cylinders, are pivoted by means of toggle levers acting on the journals of the transfer cylinders. When such a double printing unit is used as a single printing unit, again the transfer cylinders have to be thrown off relatively far, in order to make it possible to lead through the web printed or to be printed by other printing units in this thrown-off state. However, the aforementioned limits are placed on the extent of the spacing, in order to prevent the transfer cylinders from being disengaged and, in addition, there is still sufficient tooth engagement in order to stop and accelerate the switched-off double printing unit.

U.S. Pat. No. 4,458,590 shows a double printing unit with printing-unit cylinders arranged one above another, which are all mounted in side walls by means of eccentric bushes. Here, too, limits are placed on the throw-off distances of the transfer cylinders, in order that engagement conditions which are still sufficiently good are provided for the spur gears in the thrown-off state.

SUMMARY OF THE INVENTION

The invention is based on the object of providing a double printing unit in which large throw-off distances of the transfer cylinders can be realized.

According to an embodiment of the invention, this and other objects are achieved by virtue of the ability of all the printing-unit cylinders to be adjusted, thereby enabling large distances between the transfer cylinders to be realized, and which render the guide rolls for guiding the web through the print throw-off gap superfluous. An associated saving in costs and improvement in the print quality are also achieved. Furthermore, dispensing with the tooth engagement of the transfer cylinders removes the associated throw-off limits.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is to be explained in more detail below using some exemplary embodiments. In the associated drawings.

DETAILED DESCRIPTION OF THE PRESENTLY PREFERRED EMBODIMENTS

Figure 1:
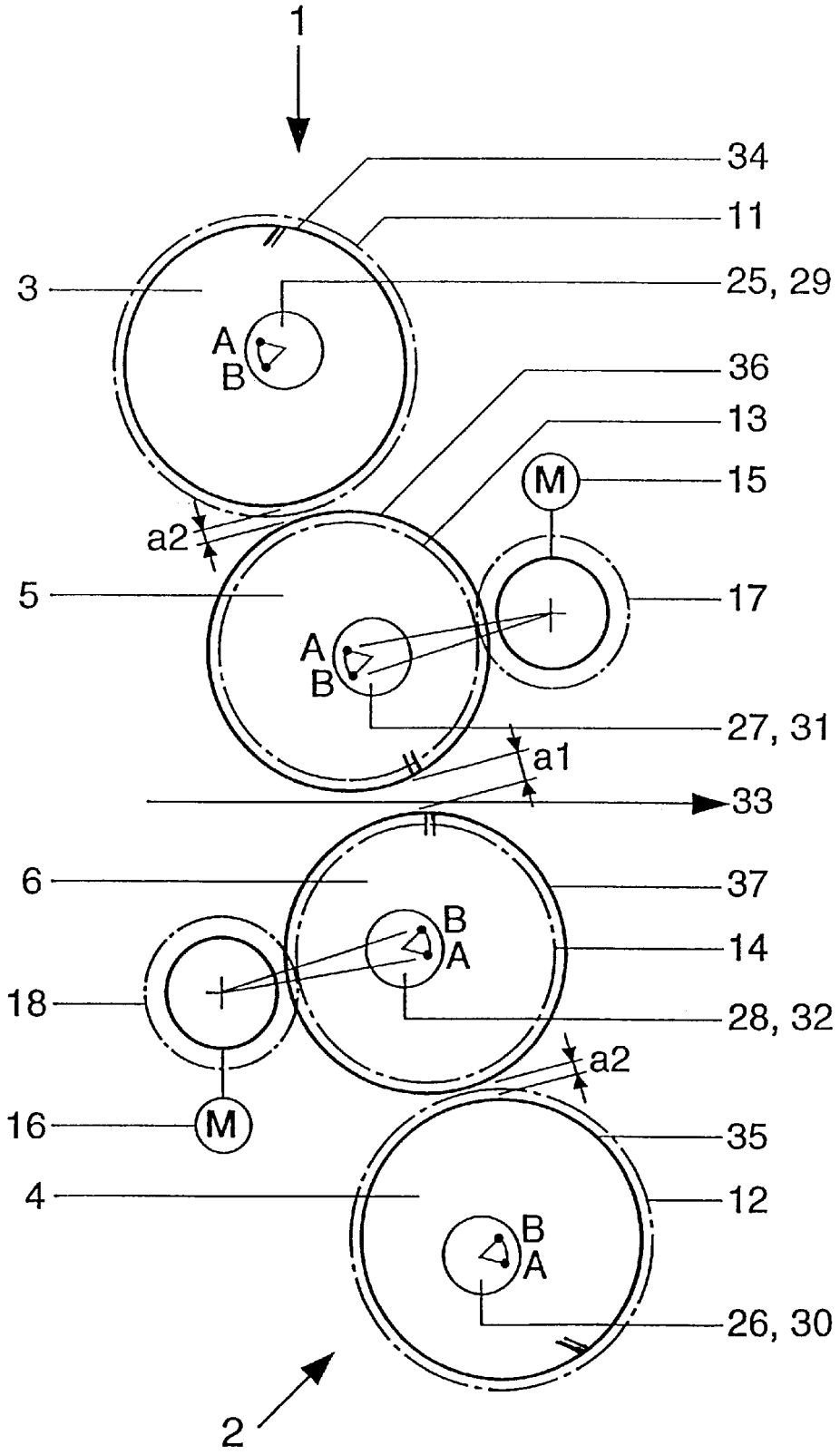
FIG. 1 is a schematic side view of a double printing unit with printing-unit cylinders mounted in eccentric bushes according to an embodiment of the invention.
Figure 2:
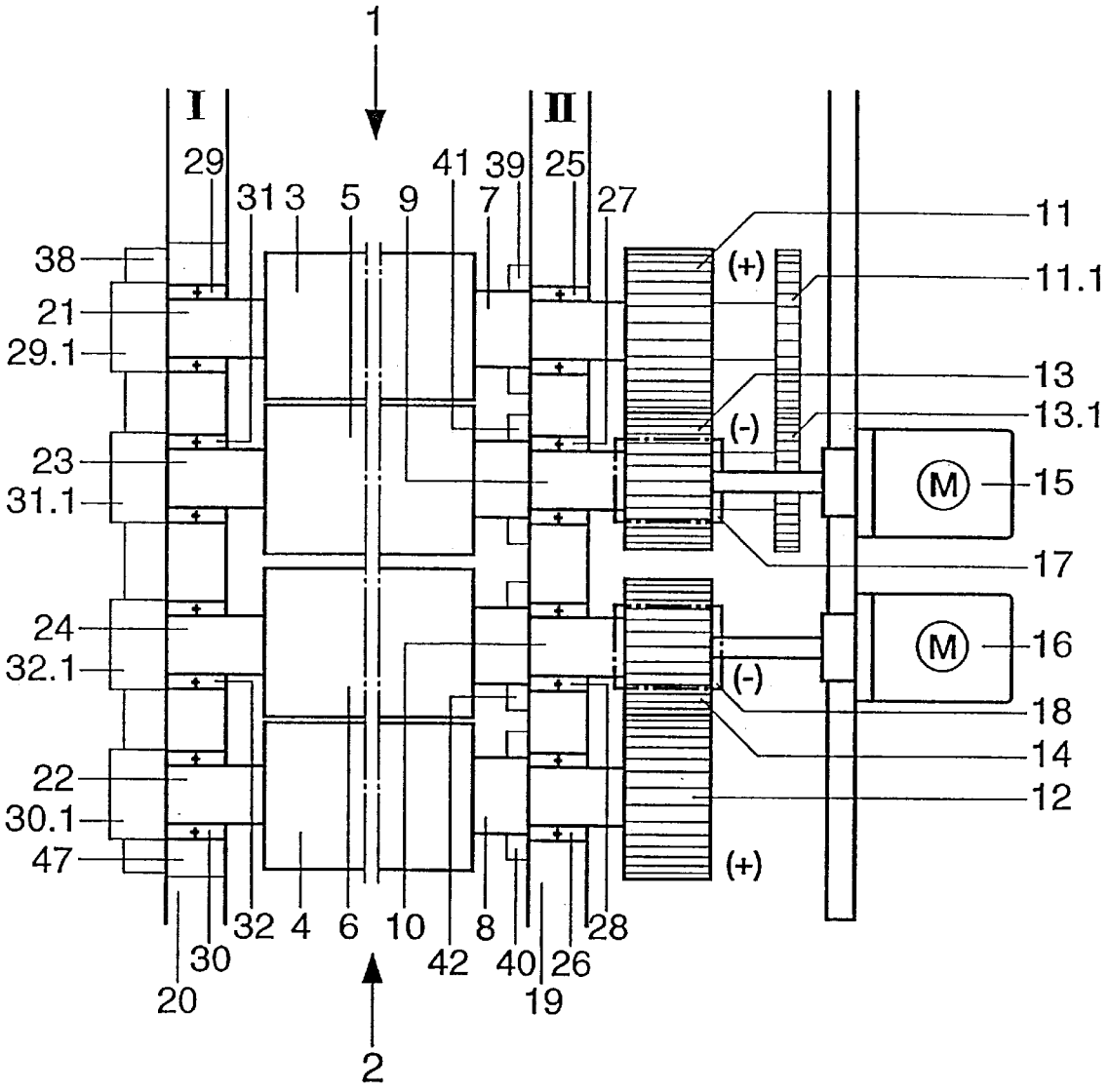
FIG. 2 is an elevational view of the double printing unit of FIG. 1.

The double printing unit shown in FIGS. 1 and 2 contains the two printing units 1, 2, each having a form cylinder 3, 4 and each having a transfer cylinder 5, 6. The form and transfer cylinders 3 to 6, also referred to as printing-unit cylinders in the following text, each bear a spur gear 11 to 14 on their drive-side journals 7 to 10, with which the form cylinder 3, 5 and the transfer cylinder 4, 6 of a printing unit 1, 2 in each case have a drive connection (FIG. 2). On the other hand, the transfer cylinders 5, 6 do not have a drive connection via their spur gears 13, 14. For this purpose, the spur gears 13, 14 are provided with an appropriate negative profile displacement. In order to maintain the required engagement relationships with the predefined axle spacings of the form and transfer cylinders 3, 5 and 4, 6, respectively, the spur gears 11, 12 have a positive profile displacement. If the profile displacements were to be dispensed with, the spur gears 11, 13 of the printing unit 1 and the spur gears 12, 14 of the printing unit 2 could also be arranged in two different planes. By way of example, spur gears 11.1, 13.1 of this type have been drawn in thin form in FIG. 2.

Each printing unit 1, 2 is driven by its own electric motor 15, 16, the electric motor 15, 16 advantageously engaging with a pinion 17, 18 in the spur gear 13, 14 of the respective transfer cylinder 5, 6. By arranging the electric motors on the bisectors of the setting angle between the thrown-on position B and the thrown-off position A, the rotational play of the flanks of the pinion 17, 18 and the spur gear 13, 14 in the thrown-on and thrown-off positions is kept low. The electric motors 17, 18 are advantageously designed as asynchronous motors.

The form and transfer cylinders 3 to 6 are mounted on both sides in side walls 19, 20. For this purpose, journals 7 to 10 and 21 to 24 are each accommodated in eccentric bushes 25 to 32 arranged so as to rotate in the side walls 19, 20.

Figure 3:
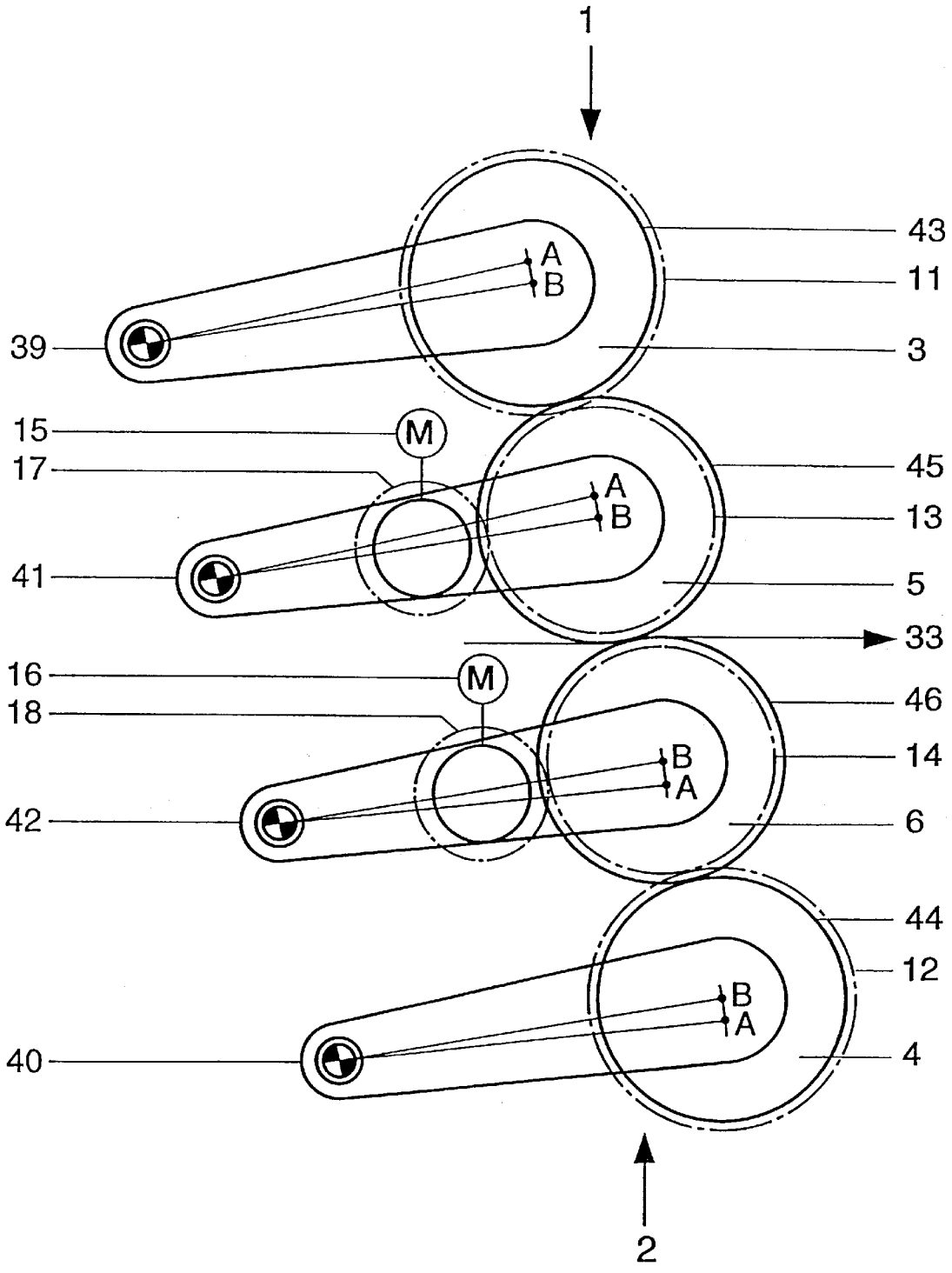
FIG. 3 is a schematic side view of a double printing unit having printing-unit cylinders mounted in pivotable supports according to an embodiment of the invention.

The actions of throwing on and throwing off the double printing unit are carried out by means of the eccentric bushes 25 to 32. In the position B of the eccentric bushes 25 to 32 (this position is not illustrated), the transfer cylinders 5, 6 are thrown onto each other, and the form cylinders 3, 4 are thrown onto the respectively adjacent transfer cylinder 5, 6. (Such a thrown-on state is shown in FIG. 3). When the printing unit 1 is driven by means of the electric motor 15 via pinion 17 and spur gears 13, 11, and the printing unit 2 is driven by means of the electric motor 16 via pinion 18 and spur gears 14, 12, web 33 is printed on both sides by the transfer cylinders 5, 6. For this purpose, the printing image is transferred from printing forms located on the form cylinders 3, 4 to a transfer form respectively on the transfer cylinders 5, 6. In the exemplary embodiment, use is made of finite printing forms 34, 35 and rubber blankets 36, 37 as the transfer form. Likewise, the printing forms and/or the transfer forms could be designed like sleeves. This is an indirect printing process, for example offset printing or gravure printing. The inking units for inking the printing plates 34, 35 and, if appropriate, the damping units in the case of offset printing, are not illustrated. The inking units are advantageously driven by the spur gear 11, 12 of the respective form cylinder 3, 4, by which flank changes caused by play in the drive gear train 17, 13, 11 and 18, 14, 12, respectively, of the printing units 1, 2 are avoided.

By rotating the eccentric bushes 25 to 32 into the thrown-off position A, the double printing unit is thrown off. In the process, the form cylinder 3, 4 is set away from the respective transfer cylinder 5, 6 by a greater amount from the respective transfer cylinder 5, 6 than the transfer cylinder 5, 6 is set away from its neighbor. As a result, a gap a1 is established between the transfer cylinders 5, 6, and a gap a2 is established between form and transfer cylinders 3, 5 and 4, 6 respectively. For example, the gap a1 can be dimensioned to be about 20 mm and the gap a2 can be dimensioned to be about 2 mm. The web 33 coming from a preceding printing unit can be led through this large gap to a following printing unit without the requirement for guide rolls, while, for example, the printing forms are being replaced in the switched-off double printing unit for a production change. The action of throwing off the printing-unit cylinders 3 to 6 can also be varied, for example in such a way that the transfer cylinders 5, 6 thrown off each other remain in contact with the associated form cylinder 3, 4. This configuration renders a special pressure roll superfluous during a printing plate change. By virtue of the ability of all the form and transfer cylinders 3 to 6 to be adjusted locally, their axes can advantageously be arranged approximately in one plane.

The form and transfer cylinders 3 to 6 can also be cantilever-mounted in only one side wall 19. In this case, the side wall 20 and the eccentric bushes 29 to 32 are rendered superfluous. Sleeve-like printing and transfer forms of such cantilever-mounted printing-unit cylinders 3 to 6 can easily be changed.

If the form cylinders 3, 4 and/or the transfer cylinders 5, 6 are fitted with sleeve-like printing forms or with rubber sleeves, the journals on the operating side of these printing-unit cylinders 3 to 6 are designed such that they are capable of being exposed. In addition, in this case the side wall 20 on the operating side has an opening 47, through which sleeve-like printing forms or transfer forms can be slid off or onto the printing-unit cylinders 3 to 6. An embodiment of this type is drawn with thin lines in FIG. 2. The opening 47 can be closed by displaceable doors 38, in which the eccentric bushes 29.1 to 32.1 are mounted when they are closed. Details on these displaceable doors can be found in commonly assigned pending U.S. application Ser. No. 09/165,023 filed on Sep. 30, 1998 now U.S. Pat. No. 6,050,190, the entire contents of which is incorporated herein by reference.

In the following exemplary embodiment, for reasons of simplicity, to a large extent the previous reference symbols are maintained for repeated or similar components. FIG. 3 shows a double printing unit having the printing units 1 and 2, each of which contains a form cylinder and a transfer cylinder 3 to 6. These printing-unit cylinders 3 to 6 are mounted on both sides or cantilever-mounted in supports 39 to 42, which are fixed in the frame of the double printing unit such that they can be pivoted. In order to dispense with a further figure, the supports 39 to 42 have also been drawn in thin form in FIG. 2. Embodiments relating to the arrangement of such supports have been described in commonly assigned U.S. application Ser. No. 09/034,781 filed on Mar. 4, 1998 now U.S. Pat. No. 6,019,039, the entire contents of which are incorporated herein by reference. The form and transfer cylinders 3, 5 and 4, 6 of each printing unit 1, 2 have a drive connection to each other via spur gears 11, 13 and 12, 14,while the transfer cylinders 5, 6 are not in tooth engagement via their spur gears 13, 14. In order to implement this condition, again the possibilities mentioned in the previous exemplary embodiment are suggested, for which reason repeated descriptions will be dispensed with. For each printing unit 1, 2, an electric motor 15, 16 is provided as the drive, which engages with its pinion 17, 18 in the spur gear 13, 14 of the transfer cylinder 5, 6. The form cylinders 3, 4 are fitted, for example, with printing-form sleeves 43, 44, and the transfer cylinders 5, 6 are fitted with rubber sleeves 45, 46. Printing plates 34, 35 and/or rubber blankets 36, 37 could also be used instead.

The motor 15 drives the printing-unit cylinders 3, 5 of the printing unit 1 via the pinion 17 and the spur gears 13, 11. The motor 16 drives the printing-unit cylinders 4, 6 of the printing unit 2 via the pinion 18 and the spur gears 14, 12. In the thrown-on position B of the supports 39 to 42 (as shown), the web 33 is printed on both sides. In order to throw the double printing unit off, the supports 39 to 42 are pivoted into the position A (thrown-off position). A gap a1 is established between the transfer cylinders 5, 6 and a gap a2 being established between the transfer cylinder 5 and form cylinder 3 and the transfer cylinder 6 and form cylinder 4 in each case. This position is not drawn in FIG. 3, but reference is made to the identical position of the printing-unit cylinders 3 to 6 in FIG. 1. Also, with regard to further functional explanations, reference is made to the previous exemplary embodiment in order to avoid repetitions.

The invention is not limited by the embodiments described above which are presented as examples only but can be modified in various ways within the scope of protection defined by the appended patent claims.

We claim:

1. A double printing unit of a rotary printing machine comprising:

two printing units each having a form cylinder, a corresponding transfer cylinder and an electric motor as a drive, said transfer cylinders being thrown onto each other to print both sides of a web passing between them in a rubber/rubber principle and being set away from each other in order to switch off the double printing unit, said form cylinders being adapted to be selectively set away from its respective transfer cylinder; and a drive connection between each form cylinder and corresponding transfer cylinder of each of said two printing units, said drive connection comprising spur gears operatively connected to said form and transfer cylinders, wherein said transfer cylinders of each of the two printing units are not connected via a toothed engagement of said spur gears.

2. The double printing unit in accordance with claim 1, further comprising eccentric bushes for mounting said form cylinders and said transfer cylinders.

3. The double printing unit in accordance with claim 1, further comprising:

a frame; and a plurality of supports pivotally mounted in said frame, said plurality of supports mounting said form and transfer cylinders in the double printing unit.

4. The double printing unit in accordance with claim 1, wherein said form cylinders are adapted to be fitted with printing form sleeves.

5. The double printing unit in accordance with claim 1, wherein said form cylinders are adapted to be fitted with printing plates.

6. The double printing unit in accordance with claim 1, wherein said transfer cylinders are adapted to be fitted with rubber blankets.

7. The double printing unit in accordance with claim 1, wherein said transfer cylinders are adapted to be fitted with rubber sleeves.

8. The double printing unit in accordance with claim 3, wherein said frame comprises side walls and wherein said form cylinders and said transfer cylinders are mounted on both sides in said side walls.

9. The double printing unit in accordance with claim 8, wherein one of said side walls comprises an opening on an operating side, said opening being adapted to enable one of a printing form and transfer form to be slid off an adjacent corresponding cylinder.

10. The double printing unit in accordance with claim 3, wherein said frame comprises side walls and wherein said form and transfer cylinders are cantilevered mounted in one of said side walls.

* * * * *